United States Patent [19]

Beck et al.

[11] Patent Number: 5,006,209

[45] Date of Patent: Apr. 9, 1991

[54] ELECTROLYTIC REDUCTION OF ALUMINA

[75] Inventors: Theodore R. Beck; Richard J. Brooks, both of Seattle, Wash.

[73] Assignees: Electrochemical Technology Corp.; Brooks Rand, Ltd., both of Seattle, Wash.

[21] Appl. No.: 479,164

[22] Filed: Feb. 13, 1990

[51] Int. Cl.[5] ..... C25C 3/06; C25C 3/18; C25C 3/08

[52] U.S. Cl. ..... 204/67; 204/243 R; 204/279; 204/291

[58] Field of Search ..... 204/67, 243 R, 291, 204/292, 279, 293; 252/62.2

[56] References Cited

U.S. PATENT DOCUMENTS 4,592,812 6/1986 Beck et al. ..... 204/67
4,865,701 9/1989 Beck et al. ..... 204/67

OTHER PUBLICATIONS

Wilkening et al., "Material problems in electrowinning of aluminum by the Hall-Heroult process", Journal of Applied Electrochemistry 19 (1989), pp. 596-604.

Grjotheim et al., *Aluminum Electrolysis Fundamentals of the Hall-Heroult Process, Aluminum-Verlag, Dusseldorf, 1982 pp. 405-411.*

*Primary Examiner*—John F. Niebling
*Assistant Examiner*—Kathryn Gorgos
*Attorney, Agent, or Firm*—Marshall, O'Toole, Gerstein, Murray & Bicknell

[57] ABSTRACT

Finely divided particles of alumina are electrolytically reduced to aluminum in an electrolytic reduction vessel having a plurality of vertically disposed, non-consumable anodes and a plurality of vertically disposed, dimensionally stable cathodes in closely spaced, alternating arrangement with the anodes. A horizontally disposed, gas bubble generator is located at the vessel bottom, underlying the cathodes and the spaces between each pair of adjacent electrodes. The vessel contains a molten electrolyte bath composed of (1) $NaF+Alf_3$ eutectic, (2) $KF+AlF_3$ eutectic and (3) LiF. The alumina particles are maintained in suspension in the molten electrolyte bath by rising gas bubbles generated at the anodes and at the gas bubble generator during the reduction process.

65 Claims, 4 Drawing Sheets

ELECTROLYTIC REDUCTION OF ALUMINA

The present invention was conceived or developed in the course of work under a U.S. government contract, namely NSF SBIR Grant ISI 8861484.

BACKGROUND OF THE INVENTION

The present invention relates generally to methods and apparatuses for the electrolytic reduction of alumina ($Al_2O_3$) to aluminum and more particularly to improvements on the methods and apparatuses disclosed in Beck et al U.S. Pat. No. 4,865,701, issued Sept. 12, 1989, the disclosure of which is incorporated herein by reference.

The conventional method long employed for the electrolytic reduction of alumina to aluminum is the Hall-Heroult process. This method and the drawbacks thereof are described in the aforementioned Beck et al. '701 patent and in another Beck et al. U.S. Pat. No. 4,592,812 issued June 3, 1986. Various prior art attempts to overcome the drawbacks of the Hall-Heroult process are summarized in Beck et al. '701 which also discloses a newer method and apparatus for attempting to overcome those drawbacks.

Basically, the Beck et al. '701 patent discloses an electrolytic reduction apparatus comprising a plurality of vertically disposed, non-consumable anodes in alternating, closely spaced relation with a plurality of vertically disposed, dimensionally stable cathodes. The electrodes are immersed in a molten electrolyte bath composed of halide salts and contained in a vessel. The bath has a density less than that of alumina and less than that of molten aluminum. Finely divided alumina particles are introduced into the bath, and a current is passed between the anodes and cathodes. As a result, molten aluminum droplets are formed at the cathodes and bubbles of gaseous oxygen are formed at the anodes.

The molten aluminum flows downwardly along each cathode toward the bottom of the vessel and accumulates there. The gaseous oxygen formed at the anodes bubbles upwardly therefrom, agitating the bath, enhancing the dissolution of alumina in those parts of the bath adjacent each anode (the boundary layer) and maintaining the undissolved, finely divided alumina particles in suspension throughout the agitated bath to produce a slurry composed of the finely divided alumina particles suspended in the molten electrolyte bath. Dissolution of alumina in the boundary layer adjacent each of the anodes is a necessary predicate for the electrolytic reduction of alumina. Because this dissolution is due, in substantial part, to agitation and transport of alumina particles to the anode, the molten electrolyte bath may be maintained at a relatively low temperature compared to the temperature required in the Hall-Heroult process wherein a relatively high temperature was necessary to maintain sufficient alumina in solution in the molten electrolyte bath. A relatively low bath temperature is desirable because it increases the current efficiency of the electrolytic reduction operation and decreases corrosion of the electrodes and of the vessel's lining.

The Hall-Heroult process employed a molten electrolyte bath typically consisting at least predominantly of $NaF+AlF_3$. Potassium fluoride was never deliberately added to the electrolyte bath employed in the Hall-Heroult process because above about 1 wt. %, KF caused an attack on the carbon cathode lining of the vessel used in that process.

SUMMARY OF THE INVENTION

The present invention employs a method and apparatus for the electrolytic reduction of alumina which differs from those employed in Beck et al. '701 in at least two respects: (1) the composition of the molten electrolyte bath; and (2) the provision of a horizontally disposed, gas bubble generator which may be an auxiliary anode or anode part at substantially the bottom of the electrolytic reduction vessel, in contact with the molten electrolyte bath, at a location underlying the primary anodes and the cathodes.

The molten electrolyte bath consists essentially of (1) $NaF+AlF_3$ eutectic, (2) $KF+AlF_3$ eutectic and (3) LiF. The ingredients which make up the molten electrolyte bath are present in percentages which provide a relatively low anode resistance, which avoid excessive corrosion of the anode and which avoid deposition of salts from the molten electrolyte bath on the cathodes.

The auxiliary anode, or the anode part, disposed at the bottom of the vessel (the bottom anode) generates bubbles of gaseous oxygen which flow upwardly from the bottom of the vessel to further prevent alumina particles from settling at the bottom of the vessel. Absent the bottom anode, or some other provision for generating gas bubbles at the vessel bottom, some alumina particles, which have a size small enough to be maintained in suspension in the molten electrolyte bath of the present invention, may agglomerate in the dry state prior to introduction into the bath, to form larger entities which can settle to form a muck on the bottom of the electrolytic reduction vessel, and this is undesirable. The bottom anode will minimize, if not entirely eliminate, the muck problem. Bubbling air or nitrogen upwardly from a gas sparger located at the vessel bottom will also maintain agglomerated alumina particles in suspension.

The combination of features employed in the method and apparatus of the present invention enables one to line the electrolytic reduction vessel with alumina and to employ an alumina thermocouple tube to measure continuously the temperature within the vessel, and there is virtually no corrosion of the alumina lining or of the alumina thermocouple tube.

The combination of features employed in accordance with the present invention permits the use of an operating temperature well below that of the Hall-Heroult process (e.g. 950° C. or 1742° F.), i.e. a temperature in the range of about 660° C. (1220° F.) to about 800° C. (1472° F.).

Other features and advantages are inherent in the method and apparatus claimed and disclosed or will become apparent to those skilled in the art from the following detailed description in conjunction with the accompanying diagramatic drawings. For example, one could use a bipolar electrode configuration employing non-consumable anode and cathode layers stably bonded together with an appropriate bonding medium.

DETAILED DESCRIPTION

Figure 1:
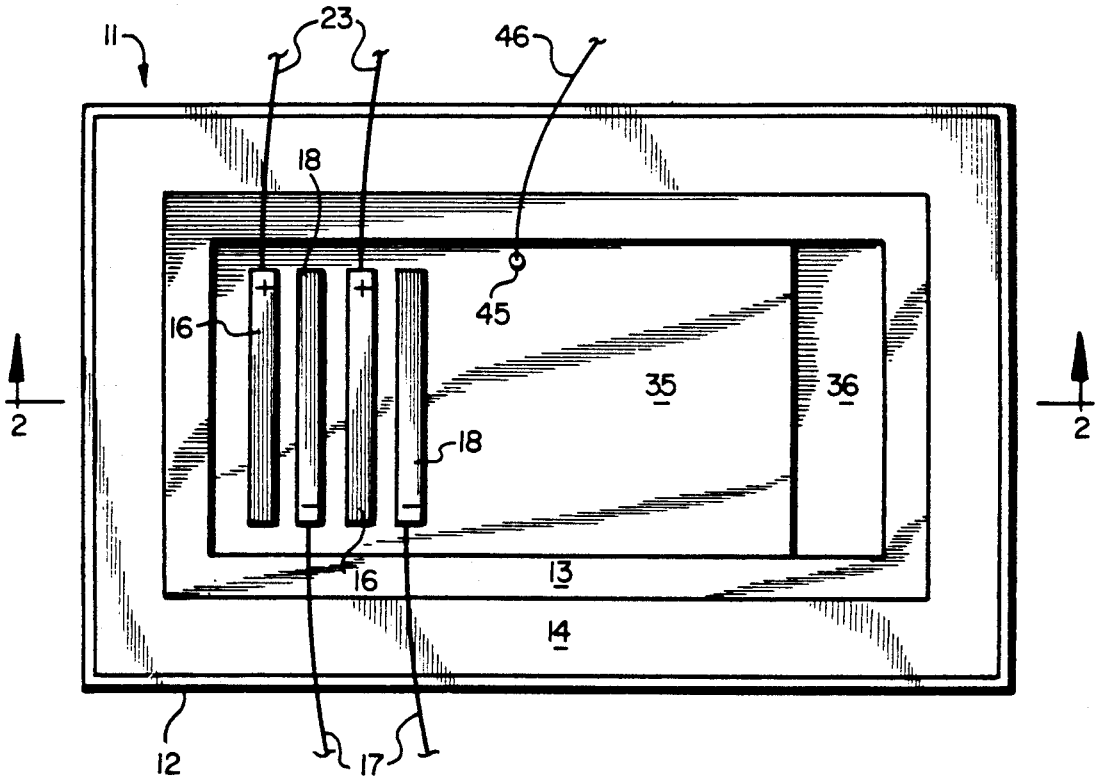
FIG. 1 is a plan view illustrating an electrolytic reduction apparatus or cell in accordance with an embodiment of the present invention.
Figure 2:
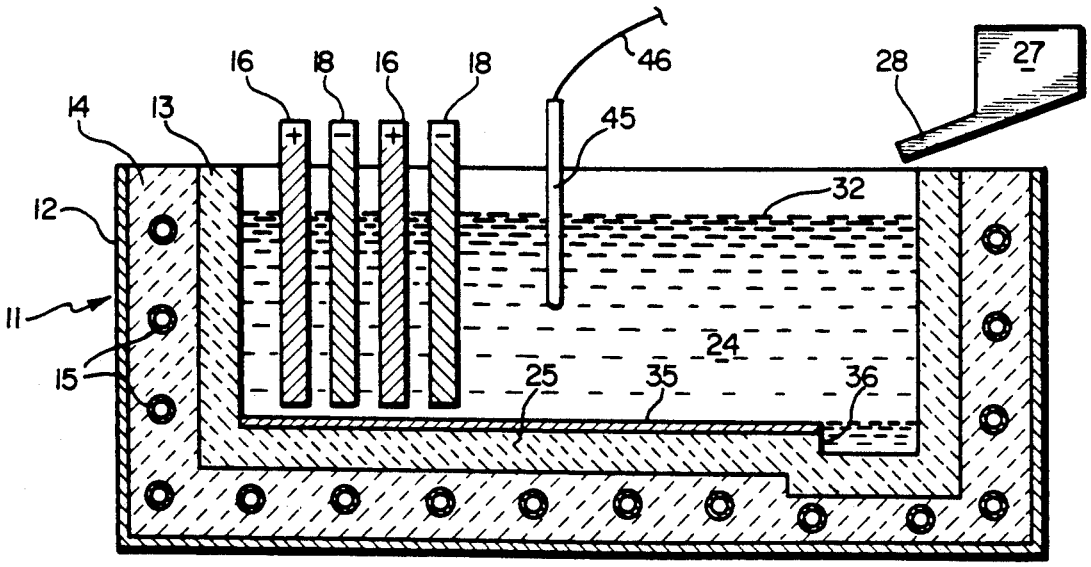
FIG. 2 is a sectional view taken along line 2—2 in FIG. 1.

Referring to FIGS. 1-2, indicated generally at 11 is an apparatus or cell for the electrolytic reduction of alumina to aluminum, constructed in accordance with an embodiment of the present invention. Apparatus or cell 11 comprises a vessel 12 having a bottom and sidewalls lined with a layer of thermal insulating material 14 within which are cooling pipes 15. Thermal insulating material 14 is typically loose alumina powder but may be other suitable material known to those skilled in the art. The interior of vessel 12 is lined with an electrically-insulating, refractory material 13, such as fused alumina.

Vessel 12 contains a molten electrolyte bath 24 composed of halide salts (to be described in more detail below) having a melting point less than that of aluminum (659° C. or 1218° F.) and having a density less than that of aluminum (2.3 g/cm$^3$) and less than that of alumina (4.0 g/cm$^3$).

An alumina thermocouple tube is depicted at 45 in FIGS. 1 and 2. Thermocouple tube 45 remains in bath 24 substantially throughout the electrolytic reduction process and continuously measures the temperature in bath 24. There is a conventional thermocouple inside tube 45, and the thermocouple is connected by a line 46 to a conventional temperature recording and/or display device (not shown).

Bath 24 has a top surface 32 through which extend a plurality of vertically disposed, spaced apart, non-consumable primary anodes 16 and a plurality of vertically disposed, spaced apart, dimensionally stable cathodes 18 in close, alternating relation with primary anodes 16. Only some of electrodes 16, 18 are shown in FIGS. 1-2. Resting on the bottom of vessel 12 is a substantially horizontally disposed, non-consumable auxiliary anode or bottom anode 35, in contact with bath 24, at a location underlying primary anodes 16 and cathodes 18. Bottom anode 35 rests atop a vessel bottom 25 which, with bottom anode 35, is inclined slightly so as to drain, into a sump 36, molten aluminum descending from cathodes 18 toward vessel bottom 25. Primary anodes 16 may be connected by conductors 23 to the cathodes in an adjacent cell (not shown), and cathodes 18 may be connected by conductors 17 to the primary anodes in the adjacent cell. Similarly, auxiliary anode 35 may be connected by a conductor (not shown) to the cathode in the adjacent cell.

Figure 4:
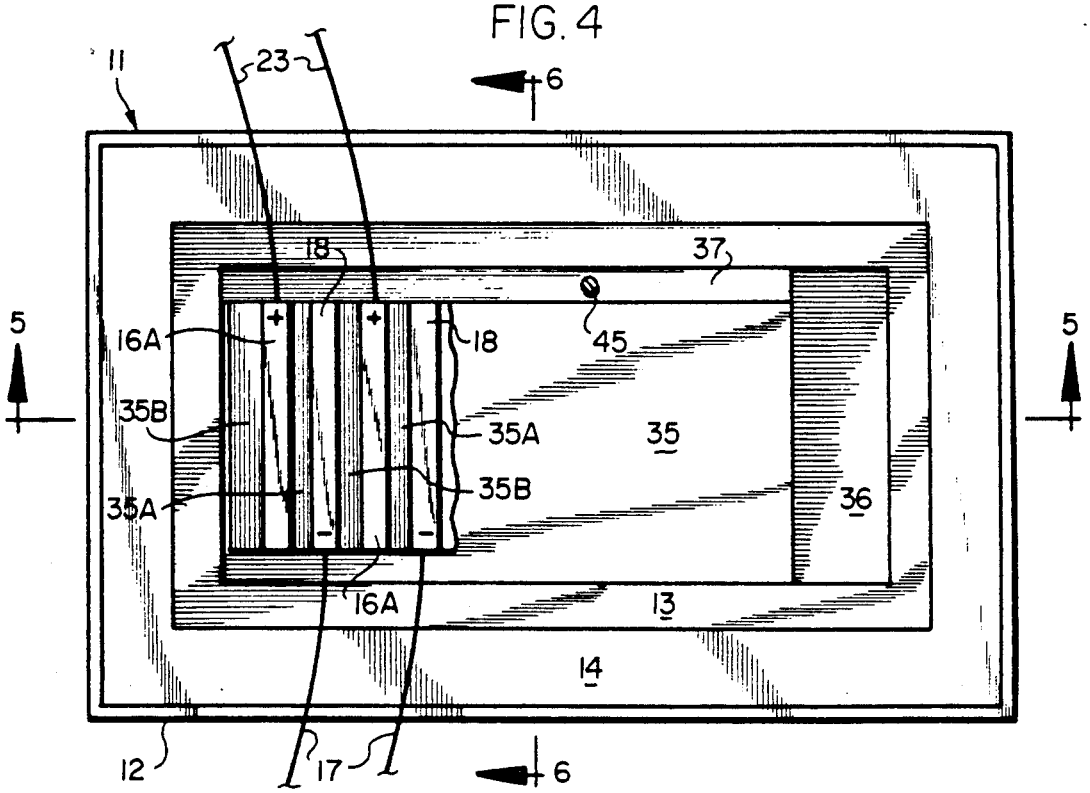
FIG. 4 is a plan view illustrating another embodiment of the present invention.
Figure 5:
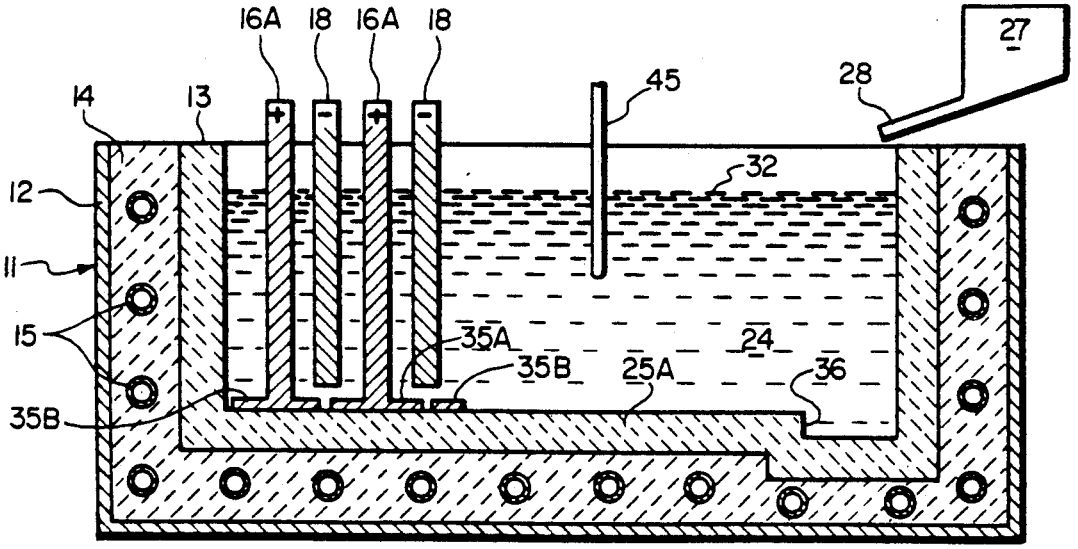
FIG. 5 is a sectional view taken along line 5—5 in FIG. 4.
Figure 6:
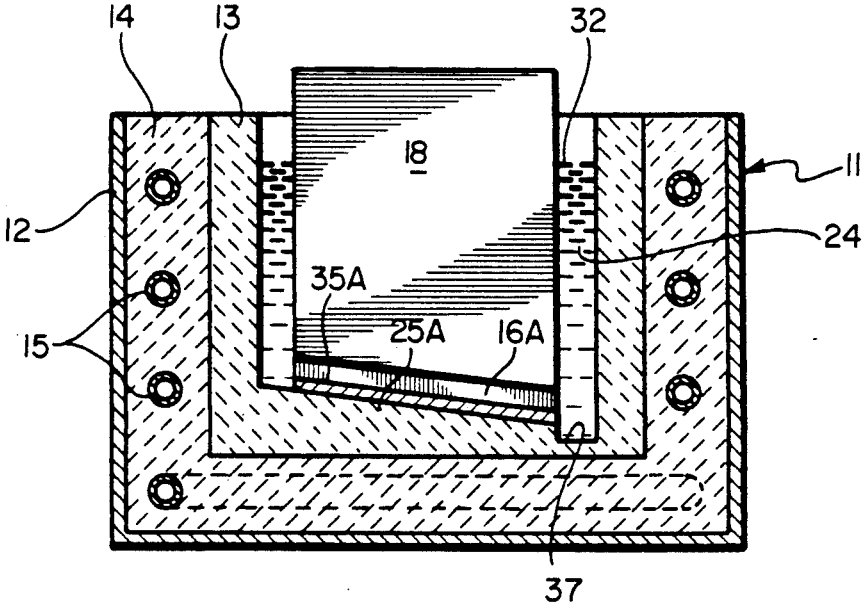
FIG. 6 is a sectional view taken along line 6—6 in FIG. 5.

One alternative to employing auxiliary anode 35 as the bottom anode is illustrated in FIGS. 4-6 wherein primary anodes 16 and auxiliary anode 35 are replaced by inverted T-shaped anodes 16A each having integral laterally disposed, anode bottom parts 35A and 35B extending in respective opposite directions at the bottom of each anode 16A. Each anode bottom part 35A and 35B underlies the space between its anode 16A and a respective adjacent cathode 18. Anode bottom parts 35A and 35B from adjacent anodes 16A cooperate to substantially underly a cathode 18 (FIG. 5). Anode bottom parts 35A and 35B and the underlying vessel bottom 25A, on which anode bottom parts 35A and 35B rest, slope downwardly to a trough 37 inclined toward sump 36 (FIGS. 4-6). Molten aluminum descending from cathodes 18 drain down sloped anode bottom parts 35A and 35B into trough 37 and then into sump 36.

Figure 8:
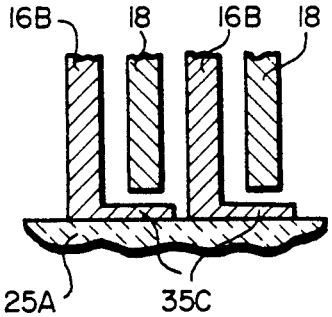
FIG. 8 is a fragmentary sectional view illustrating a portion of a further embodiment of the present invention.

A variation of inverted T-shaped anode 16A is an L-shaped anode 16B having a single, laterally extending anode bottom part 35C underlying the space between its anode 16A and an adjacent cathode 18 and also at least substantially underlying the adjacent cathode 18 (FIG. 8).

The molten electrolyte bath consists essentially of (1) $NaF+AlF_3$ eutectic, (2) $KF+AlF_3$ eutectic, and (3) LiF. The molten electrolyte has a composition in the region A on the triangular compositional diagram for $NaF+AlF_3$ eutectic—$KF+AlF_3$ eutectic—LiF, depicted in FIG. 3, and this will be discussed subsequently in more detail.

Expressed in terms of the individual ingredients included therein, the electrolyte consists essentially of, in wt. % adjusted to exclude impurities:

| | |
|---|---|
| NaF | 6-26 |
| KF | 7-33 |
| LiF | 1-6 |
| $AlF_3$ | 60-65 |

Examples of electrolyte bath compositions in accordance with the present invention are tabulated below.

| | Bath Composition, Wt. % | | | | |
|---|---|---|---|---|---|
| | A | B | C | D | E |
| NaF | 24.5 | 25.1 | 16.8 | 11.2 | 6.0 |
| KF | 7.6 | 7.8 | 15.7 | 22.6 | 32.1 |
| LiF | 5.1 | 3.2 | 4.2 | 4.1 | 1.1 |
| $AlF_3$ | 62.8 | 63.9 | 63.3 | 62.1 | 60.8 |

The composition of baths A-D in the foregoing tabulation have been adjusted to reflect the exclusion, in the tabulation, of $Al_2O_3$ impurities associated with the $AlF_3$, there being 91 wt. % $AlF_3$ and 9 wt. % $Al_2O_3$ in a typical $AlF_3$ material.

Anodes 16 and 35 are preferably composed of a Ni-Fe-Cu cermet, examples of which are described in the Beck et al. '701 patent.

Cathodes 18 are typically composed of an electrically conductive, refractory hard metal which is wet by molten aluminum and stands up well in the bath under the operating conditions of the present invention. The preferred cathode material is titanium diboride ($TiB_2$). Other useful cathode materials are described in the Beck et al. '701 patent.

Alumina particles may be added to the bath, through the top of the bath, in any convenient location and manner, e.g., from a hopper 27 through a conduit 28 (FIG. 2).

During operation of cell 11 (FIGS. 1-2), electric current is passed through bath 24 from auxiliary anode 35 and from each primary anode 16 to each cathode 18. As will be explained more fully below, alumina introduced into bath 24 becomes dissolved therein, e.g. in a boundary layer adjacent primary anodes 16, and is formed into ions of aluminum and oxygen. In the course of a series of reactions, the aluminum ions are converted into metallic aluminum at each cathode 18 and the oxygen ions are converted into gaseous oxygen at each primary anode 16 and at auxiliary anode 35.

The layer of titanium diboride or other refractory hard metal at the surface of each cathode 18 is wet by the aluminum which flows downwardly along the titanium diboride cathode surface toward the cell bottom 25 which, together with auxiliary anode 35, is sloped toward a sump 36 into which the molten aluminum drains. During operation, a protective oxide forms on the upper surface of auxiliary anode 35, and this prevents the molten aluminum which settles onto auxiliary anode 35 from reacting or alloying with the material (e.g. Cu in the cermet) of which auxiliary anode 35 is composed.

The gaseous oxygen which forms at each primary anode 16 bubbles upwardly through bath 24 to agitate the bath adjacent each primary anode. This agitation enhances the dissolution of the alumina in the electrolyte bath and maintains a substantial saturation of dissolved alumina in that part of the bath (i.e. the boundary layer) adjacent each primary anode 16, which is desirable. The agitation caused by the upwardly bubbling gaseous oxygen from each primary anode also maintains the undissolved alumina particles in suspension throughout the bath and substantially inhibits alumina particles within the bath from settling at the bottom of cell 11. The gaseous oxygen bubbling upwardly from auxiliary anode 35 contributes to the performance of each of the functions performed by the gaseous oxygen bubbles generated at primary anodes 16. As a result, a slurry composed of alumina particles suspended in the molten electrolyte bath is maintained substantially uniformly throughout cell 11.

In the embodiments of FIGS. 4–6 and 8, auxiliary anode 35 is replaced, as a gaseous oxygen bubble generator, either by anode bottom parts 35A and 35B of inverted T-shaped anodes 16A (embodiment of FIGS. 4–6) or by anode bottom parts 16C of L-shaped anodes 16B (embodiment of FIG. 8). Otherwise the embodiments of FIGS. 4–6 and 8 operate essentially the same as the embodiment of FIGS. 1–2.

Figure 9:
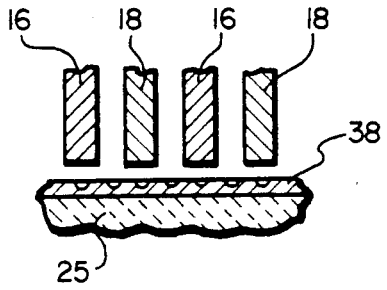
FIG. 9 is a fragmentary sectional view illustrating a portion of still another embodiment of the present invention.

As an alternative to employing bottom anodes such as 35, 35A–B or 35C as generators of gas bubbles, one may employ a gas sparger 38 (FIG. 9) at the same location as where the bottom anodes were located to direct gas bubbles (e.g. air or nitrogen) upwardly into the bath. Except for the gas sparger, and the absence of bottom anodes, the embodiment of FIG. 9 operates essentially the same as the other embodiments.

The alumina is composed of finely divided particles having a mean size, expressed as equivalent spherical diameter, greater than about 1 micron and less than about 100 microns, preferably a mean size in the range of about 2 to about 10 microns. Generally speaking, the smaller the alumina particles, the easier it is to maintain the alumina particles in suspension in the molten electrolyte bath and the lesser the tendency to settle out on the bottom of the cell, settling being undesirable. However, very fine alumina particles, when in the dry state prior to introduction into bath 24, may agglomerate into larger entities which have a tendency to settle out toward the bottom of the bath and form a muck at the bottom of the vessel, which is undesirable. Bottom anode 35 or bottom anodes 35A–B or 35C or sparger 38 are provided as gas generators to cope with this problem.

More particularly, the gas generated at the cell bottom bubbles upwardly through bath 24 to agitate at least that part of the bath above the gas generator at the cell bottom and below the level of the bottom of cathodes 18. This contributes substantially to the avoidance of muck formation at the bottom of vessel 12, whether the alumina which would otherwise settle at the vessel bottom is an agglomeration or of some other form.

Oxygen bubbling upwardly through top surface 32 of bath 24 may be accumulated within an exhaust hood (not shown) communicating with an exhaust conduit (not shown).

The temperature in cell 11 is controlled by cooling pipes 15. A cell in accordance with the present invention is operated at a temperature in the range of about 660° C. (1220° F.) to about 800° C. (1472° F.). The temperature within cell 11 should be at least slightly above the melting point of aluminum (659° C. or 1218° F.) and substantially below the operating temperature of the Hall-Heroult process (950° C. or 1742° F.). A preferred operating temperature is in the range 730°–760° C. (1346°–1400° F.). In comparison to the Hall-Heroult operating temperature of 950° C., the cooler operating temperatures of the present invention increase the cell's current efficiency, reduce corrosion of the refractory hard metal surface on the cathode, reduce corrosion of the anodes, and reduce corrosion of the fused alumina which lines the interior of vessel 12.

A minimum operating temperature of 730° C. is preferred because below that temperature (e.g. at 700° C.), there can be an anode effect, an undesirable condition at the anode which increases the voltage drop through the bath and decreases energy efficiency. It is preferred to operate at a current density of about 0.5 $A/cm^2$ at the anodes, and this can be accomplished at the preferred minimum temperature of about 730° C. In contrast, the economic optimum current density in the Hall-Heroult process approaches 1 $A/cm^2$.

The molten electrolyte of which bath 24 is composed is capable of dissolving some alumina. In accordance with the present invention, the percentage of alumina, introduced into the slurry as alumina particles, is high enough to at least contribute, together with the lower operating temperature, to the avoidance of substantial corrosion of the alumina interior lining by the molten electrolyte. Accordingly, the slurry has an alumina content maintained at a percentage of at least 2 wt. %, preferably 5 wt. % or more.

When the bath has an alumina particle content above about 2 to 5 wt. % and the cell has an operating temperature in the range 660°–800° C., the corrosion rate of fused alumina lining 13 and of alumina thermocouple tube 45 is essentially insignificant. This low corrosion rate enables one to employ fused alumina as the vessel interior lining and eliminates the need to employ a carbon interior lining as in the Hall-Heroult process which in turn eliminates the need to employ a frozen ledge of electrolyte along the interior lining which can then be better thermally insulated to conserve heat energy. A frozen ledge of electrolyte was necessary to protect the vessel's carbon interior lining when employing the Hall-Heroult process. The frozen ledge was produced by employing reduced thermal insulation, compared to that employed in the present invention at 14, and resulted in the loss of heat energy which can be saved when employing the present invention.

Continuous measurement of the bath temperature employing an alumina thermocouple tube is economically feasible, when practicing the present invention. It has not been feasible in the highly corrosive, high temperature sodium cryolite bath ($Na_3AlF_6$) conventionally used in Hall-Heroult cells.

The percentage of alumina in the slurry must be low enough to provide the slurry with a density less than that of molten aluminum (2.3 g/cm$^3$). Alumina has a density of about 4.0 g/cm$^3$. Accordingly, the amount of alumina added must be controlled so that the density of the resulting slurry does not exceed 2.3 g/cm$^3$. Without considering other factors, a slurry with an alumina content of less than about 20 wt. % would have a density within the desired range. However, in practice, the finely divided oxygen bubbles issuing from anodes 16, 16A or 16B, each of which extend vertically through the entire bath, decrease the slurry density so that in such cases an alumina content up to 30 wt. % may be employed. In a slurry having an alumina content above about 30 wt%, the density and viscosity of the slurry are so high that they interfere with the settling of the molten aluminum droplets to the bottom of the vessel and with the circulation of the alumina particles within the bath to provide a uniform slurry composition throughout.

In summary, the slurry should have an alumina content in the range 2–30 wt. %, preferably in the range 5–10 wt. %.

The considerations involved in the selection of the composition for the molten electrolyte will now be discussed in the context of cell operating temperatures in accordance with the present invention, preferably 730° C.–760° C.

The molten electrolyte employed in the Hall-Heroult process is composed of $NaF+AlF_3$ having a weight ratio of $NaF:AlF_3$ in the range 1.1 to 1.5 and a temperature of about 960° C. (A eutectic composition of $NaF+AlF_3$ has a weight ratio of NaF to $AlF_3$ of 0.64 and has a freezing point of 685° C.). At operating temperatures in accordance with the present invention (e.g. 750° C.), there is an undesirable deposition of bath salts onto the cathodes when employing an electrolyte composed of $NaF+AlF_3$ eutectic. These cathode deposits are composed primarily of cryolyte ($Na_3AlF_6$) with small quantities of metallic aluminum dispersed therein. It was determined that the cathode deposit problem could be avoided by employing, in the bath composition, relatively large amounts of LiF (e.g. 9–30 wt. % or more). Although this eliminated the cathode deposit problem, it produced another problem, namely corrosion of test anodes comprising Cu or Cu-Ni-Fe cermets.

Potassium fluoride was substituted for NaF in a bath also containing $AlF_3$ and without LiF. However, as with the bath composed of $NaF+AlF_3$ eutectic, a bath composed of $KF+AlF_3$ eutectic produced a cathode deposit problem. It was then determined that a mixture of (1) $NaF+AlF_3$ eutectic and (2) $KF+AlF_3$ eutectic eliminated the cathode deposit problem. However, such a mixture, in amounts of each which avoided the cathode deposit problem, produced another problem, namely a relatively high anode resistance which interfered with the flow of current between the electrodes. This problem was solved by adding small amounts of LiF to the bath. Too much LiF, however, causes excess anode corrosion.

Figure 3:
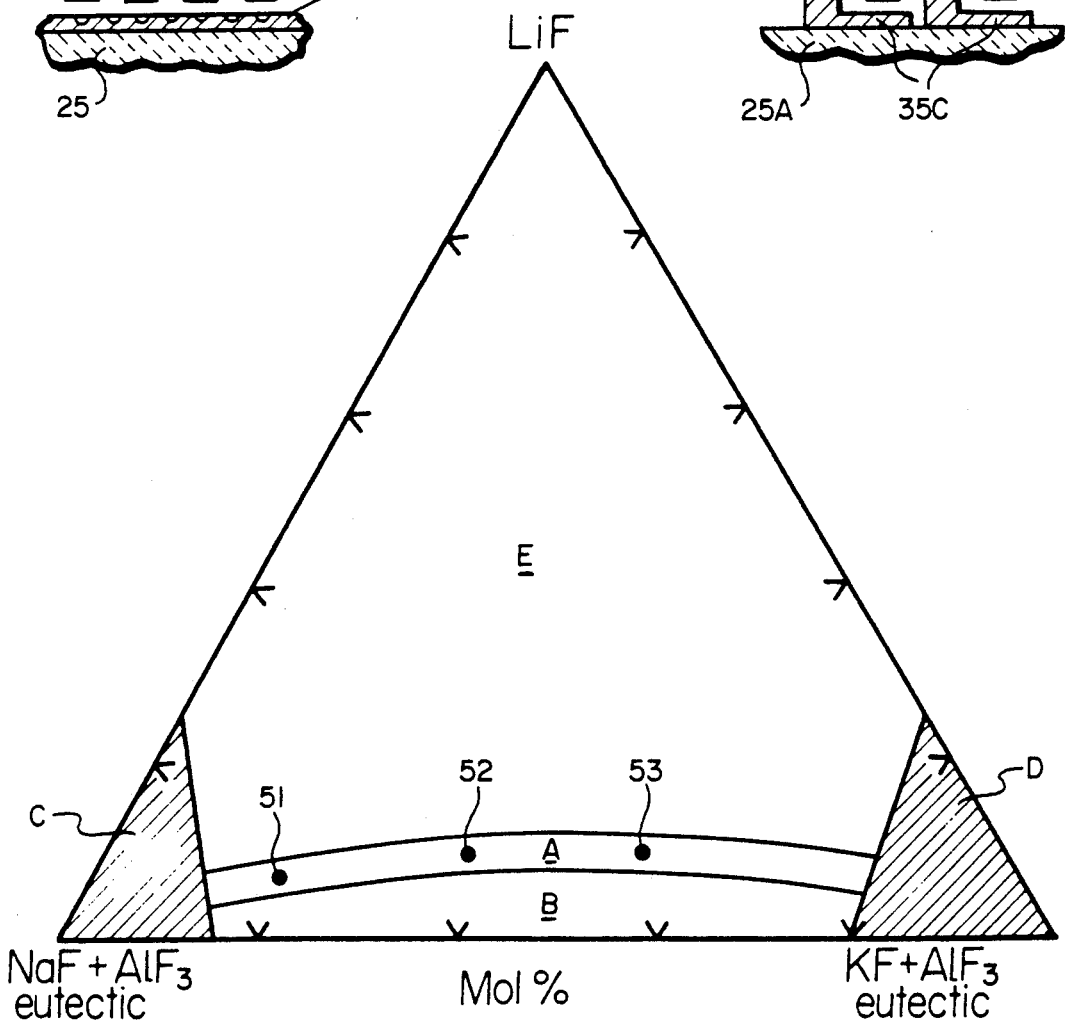
FIG. 3 is a triangular compositional diagram for the system $NaF+AlF_3$ eutectic—$KF+AlF_3$ eutectic—LiF.

In summary, the composition of the electrolyte must balance all of the considerations described above to produce a molten electrolyte having a composition in the region A on the triangular compositional diagram for $NaF+AlF_3$ eutectic—$KF+AlF_3$ eutectic—LiF, depicted in FIG. 3. In FIG. 3, the content of each of the three components of the triangular compositional diagram is expressed as Mol % along the three borders of the triangular diagram. At region B, there is excessive anode resistance. At region E, there is excessive corrosion of the anode. At each of regions C and D, there is a problem with cathode deposits.

Compositions reflected by locations 51, 52 and 53 in region A of FIG. 3 are examples of electrolytes in accordance with the present invention. A composition at location 51 would be economically most desirable because NaF is less costly than KF. Compositions in accordance with baths A-E, described previously, would fall within region A of FIG. 3.

The following discussion reports on some of the tests conducted in the course of ascertaining the bath composition and other parameters of the present invention. Unless otherwise indicated, the tests employed the test apparatus illustrated in FIG. 7 and the test conditions summarized two paragraphs below.

Figure 7:
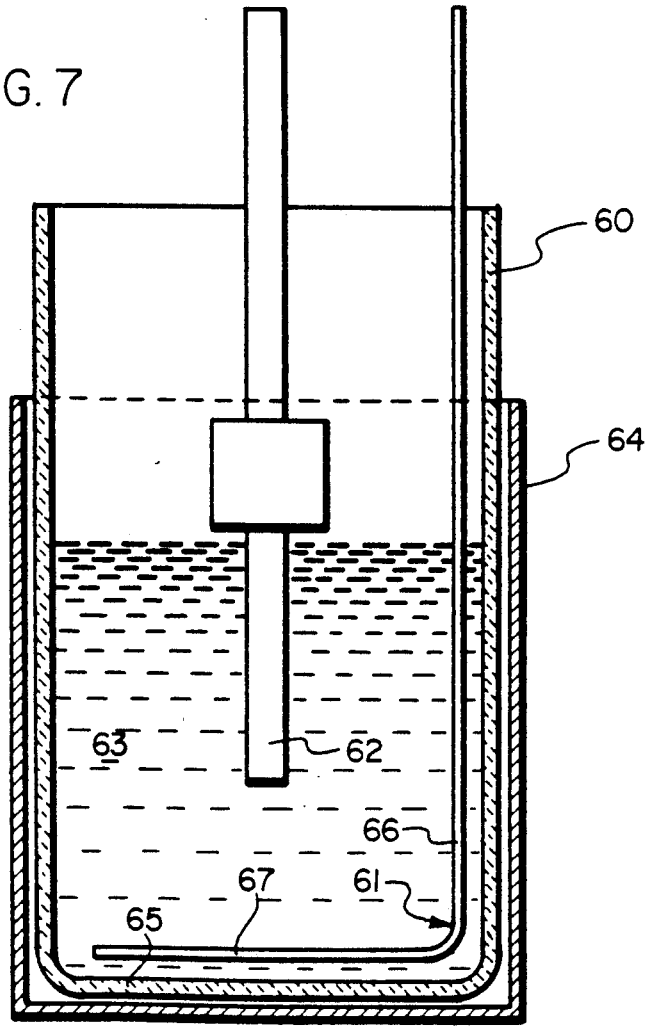
FIG. 7 is a vertical sectional view of a test cell employing some of the features of the present invention.

The test apparatus illustrated in FIG. 7 is a laboratory cell comprising a fused alumina crucible 60 having a volume of 500 cm$^3$and containing an anode 61, a cathode 62, and a bath 63 comprising a molten electrolyte. Alumina crucible 60 is positioned within a stainless steel retaining can 64. Cathode 62 is a 4 mm thick slab of $TiB_2$ with an immersed area of about 20 cm$^2$. Anode 61 comprises (1) a disc 67 of copper overlying and substantially covering the bottom 65 of crucible 60 and (2) a vertical copper strip 66 having a lower end integral with disc 67 and an upper end connected to a source of electrical current. A copper anode was used as a test expedient to evaluate appropriate bath compositions.

The assembly was placed in a furnace and held at an elevated temperature measured continuously with a chromel-alumel thermocouple in a closed-end, fused alumina tube. There was no measurable corrosion of the fused alumina tube when the average alumina content added to the bath was greater than about 5 wt. %. The alumina solubility in the bath is estimated to be 1–2 wt. %. The alumina particles were ground to a mean particle size of about 1 mm. The total bath weight, including added alumina particles, was 350 grams. All composition percentages reported below are wt. %.

Test 1

The bath composition was 35.8% NaF, 6.9% LiF, and 57.3% $AlF_3$ to which was added 10% $Al_2O_3$. The cell was operated for 6.5 hours at 20 amperes and 740° C. The aluminum current efficiency was 70%. The copper anode corrosion rate was 0.039 g/cm$^2$. hour at a current density of 0.64 A/cm$^2$. At the end of the run, the $TiB_2$ cathode had a solid deposit of salt from the bath about 1 cm thick and containing aluminum droplets. The deposit was similar to that described for low ratio cryolite by Sleppy and Cochran, Light Metals 1979, p. 385, The Metallurgical Society, Warrendale, Pa.

Test 2

The bath contained 19.0% NaF, 24.0% LiF and 57.0% $AlF_3$ to which was added 10% $Al_2O_3$. The cell was operated at 20 amperes and 740° C. for 7.0 hours. The aluminum current efficiency was 71%. No salt deposit formed on the cathode in this run or in other runs using the same bath composition. Anode corrosion was 0.07 g/cm$^2$ hour.

Test 3

The bath contained a eutectic, low-ratio cryolite comprising 31.2% NaF, 8.0% CaF2 and 60.8% $AlF_3$ to which was added 10% $Al_2O_3$. The cell ran for 5.0 hours at 20 amperes and 750° C. The run was stopped because of a large deposit on the cathode of salt containing metal droplets. The aluminum current efficiency was only about 7%. Anode corrosion was 0.084 g/cm$^2$ hour.

Test 4

The bath contained a low-ratio potassium cryolite having a 570° C. freezing point and comprising 46.8% KF and 53.2% $AlF_3$ to which was added 10% $Al_2O_3$. The cell temperature was 750° C. Initially, the cell had a high resistance which was determined to be at the copper anode. The addition of 3% LiF, one percent at a time, decreased the resistance and allowed the cell to run at normal current and voltage. The current was off during each addition of LiF. The cell then ran for 6.5 hours at 20 amperes. At the end of the run a large salt deposit was found to have formed on the cathode, and what little metal was produced occurred in droplets in the salt deposit. Aluminum current efficiency was therefore negligible. However, anode corrosion was only 0.017 g/cm$^2$ hour.

Test 5

The bath contained 25.9% NaF, 8.1% KF, and 66.0% $AlF_3$ to which was added 10% $Al_2O_3$. The cell temperature was 740° C. It was again found that the cell had a high initial resistance which was lowered by addition of 3% LiF, one percent at a time. The current was off during each addition of LiF. The cell then ran at 20 amperes for 6.0 hours. No cathode salt deposit formed. Aluminum current efficiency was 69%. Copper anode corrosion was 0.015 g/cm$^2$ hour.

Test 6

The bath contained 17.5% NaF, 16.4% KF, and 66.1% $AlF_3$ to which was added 10% $Al_2O_3$. The cell temperature was 740° C. The cell had a high initial resistance which was lowered by addition of 4% LiF, one percent at a time, with current off at each addition. The cell then ran at 20 amperes for 6.5 hours. No cathode salt deposit formed, and the aluminum current efficiency was 68%. The copper anode corrosion rate was 0.026 g/cm$^2$ hour.

Test 7

The bath contained 11.6% NaF, 23.6% KF, and 64.8% $AlF_3$ to which was added 10% $Al_2O_3$. The cell temperature was 740° C. The cell had an initial high resistance which was lowered by addition of 4% LiF, one percent at a time, with current off at each addition. The cell ran at 20 amperes for 7.0 hours. No cathode deposit formed, and the aluminum current efficiency was 73%. The copper anode corrosion rate was 0.024 g/cm$^2$ hour.

Data from other tests employing various bath compositions containing LiF showed that the corrosion rate of the copper anode generally increased with LiF % above 5 wt. %. The data also showed a lower copper anode corrosion rate and a lower cell voltage (decreased resistance) when the current was turned on and off several times at the beginning of a run, for a given LiF % in the bath.

A surprising result in all of these runs was that balls of produced aluminum resting on the copper anodes in the baths did not react with the copper anodes. A copper oxide film which forms on the anode and the release of oxygen from the anode surface apparently kept the aluminum from alloying with the copper.

Test 8

The bath had the same composition as in Test 5 and the same $TiB_2$ cathode as in Tests 1–7. The anode was a vertically disposed, hot-pressed cermet cylinder 9 mm in diameter and 18 mm long. The cermet composition was a nickel ferrite ($NiFe_2O_4$) containing 17% copper. Electrical connection to the cermet was made by forcing a stainless steel rod into a hole in the cylinder's top end. The hole was drilled with a diamond bit. The cell temperature was 730° C. The cell had high resistance initially, and 3% LiF was added, one percent at a time, while stirring with the current off at each addition. After all the LiF was added, the voltage was a steady 3.9 volts at a current of 2.5 amperes, and the anode current density was 0.5 A/cm$^2$. No cathode salt deposit was formed, and the aluminum current efficiency was about 40%. The cermet anode sustained no visible corrosion, and the anode edges were still sharp. By weight loss, the corrosion rate was only 0.004 g/cm$^2$ hour.

As noted above, a bath composition without LiF but otherwise in accordance with the present invention produces excessive anode resistance, which is undesirable. Tests 4–8 showed that when the same bath also contains small amounts of LiF (e.g. about 1–6 wt. %), there may be excessive anode resistance at the start of a run, but this can be overcome by turning the current on and off a few times during the beginning stages of the run; and there will be decreased anode resistance thereafter. The reason why such benefits are obtained by employing the current on-off treatment at the beginning of a run is not known for certain, but one proposed explanation is set forth in the following two paragraphs.

An oxide of copper forms at a copper-containing anode when the current is initially turned on, and this occurs both (1) when the anode is composed essentially of copper and (2) when the anode is composed of a cermet including copper as one of its constituent ingredients. The copper oxide increases the resistance at the anode, and this is undesirable.

A small percentage of LiF, e.g. 1–6 wt. %, can be employed to offset the increased anode resistance resulting from the the formation of copper oxide at the anode while still meeting the other requirements of the present invention (avoidance of cathode deposit and anode corrosion while operating at a bath temperature preferably in the range 730° to 750° C.). However, it is apparently necessary for $Li^+$ions to be in the copper oxide on the surface of the copper anode or in the copper oxide in the cermet in order to obtain a low anode resistance. The potential gradient in the anode is in a direction to drive the $Li^+$ions out of the oxides. A high initial resistance and the resulting high electric field (i.e. voltage or potential) prevents $Li^+$ions from getting into the anode's copper oxide when the current is initially turned on to a constant value and left on. On the other hand, if, after an initial passage of current, the current is turned off at the beginning stages in the performance of the method and the anode is left in the bath, $Li^+$ions can enter an anode's copper oxide through diffusion by means of a concentration gradient. Once $Li^+$ions are in the copper oxide, the resistance and electric field are low, and the $Li^+$ions are not driven out.

Although ground alumina particles were used in the tests described above, it is expected that the conventionally employed Bayer process will be modified to produce directly particles of alumina of the right size distribution.

The following table summarizes the results obtained in Tests 1–8. The "bath" composition is the electrolyte composition, i.e. without added alumina, and that composition is expressed in parts because, in Tests 4–8, the numbers add up to over 100 due to LiF being added to the bath in steps after the initial bath composition was formulated to 100%. The bath compositions employed in Tests 5–8 are in accordance with the present invention.

| Test No. | Bath Composition in Parts | | Current Efficiency % | Anode Corrosion Rate, $g/cm^2 \cdot hr.$ | Cathode Deposit Thickness |
|---|---|---|---|---|---|
| 1 | NaF | 35.8 | 70 | 0.039 | 1 cm |
| | LiF | 6.9 | | | |
| | $AlF_3$ | 57.3 | | | |
| 2 | NaF | 19.0 | 71 | 0.07+ | — |
| | LiF | 24.0 | | | |
| | $AlF_3$ | 57.0 | | | |
| 3 | NaF | 31.2 | 7 | 0.084 | large |
| | CaF | 8.0 | | | |
| | $AlF_3$ | 60.8 | | | |
| 4 | KF | 46.8 | negligible | 0.017 | large |
| | $AlF_3$ | 53.2 | | | |
| | LiF | 3 | | | |
| 5 | NaF | 25.9 | 69 | 0.015 | — |
| | KF | 8.1 | | | |
| | $AlF_3$ | 66.0 | | | |
| | Lif | 3 | | | |
| 6 | NaF | 17.5 | 68 | 0.026 | — |
| | KF | 16.4 | | | |
| | $AlF_3$ | 66.1 | | | |
| | LiF | 4 | | | |
| 7 | NaF | 11.6 | 73 | 0.024 | — |
| | KF | 23.6 | | | |
| | $AlF_3$ | 64.8 | | | |
| | LiF | 4 | | | |
| 8 | NaF | 25.9 | 40 | 0.004 | — |
| | KF | 8.1 | | | |
| | $AlF_3$ | 66.0 | | | |
| | LiF | 3 | | | |

In the examples reflected by Tests 4–8, LiF was added in increments while the current was turned off. Typically, there were 3 or 4 cycles in which the current was on and then off and these cycles occurred during the beginning stages in the performance of the method. The "on" part of an on-off cycle was 3–5 minutes, and the "off" part of the cycle was about one minute, these time periods being examples only. Copper oxide is generated at each anode during the on part of a cycle, and $Li^+$ions are incorporated into the copper oxide during the off part of the cycle, to decrease anode resistance during the performance of the method.

The LiF need not be added in increments. Instead, LiF may be included in the bath from the start so long as one follows a procedure employing a plurality of on-off cycles during the beginning stages in the performance of the method. When employing such a procedure, (1) an oxide of copper is formed at each anode during the on part of at least the first on-off cycle and (2) $Li^+$ions are then incorporated into the oxide of copper during the off part of the on-off cycle.

The foregoing detailed description has been given for clearness of understanding only, and no unnecessary limitations should be understood therefrom, as modifications will be obvious to those skilled in the art.

We claim:

1. A method for the electrolytic reduction of alumina to aluminum in a vessel having a bottom and sidewalls, said method comprising the steps of:

containing within said vessel a molten electrolyte bath consisting essentially of (1) $NaF+AlF_3$ eutectic, (2) $KF+AlF_3$ eutectic and (3) LiF;

said molten electrolyte bath having a density less than the density of molten alumina and less than the density of alumina;

maintaining said bath at a temperature substantially below 950° C.;

providing within said bath a plurality of vertically disposed, spaced apart, non-consumable anodes and a plurality of vertically disposed, spaced apart, dimensionally stable cathodes in close, alternating relation to said anodes, with a space defined between each pair of adjacent electrodes;

introducing finely divided alumina particles into said bath;

passing an electric current through said bath from said anodes to said cathodes;

forming bubbles of gaseous oxygen at each of said anodes;

allowing said bubbles to pass upwardly from said anodes;

forming a slurry composed of said finely divided alumina particles suspended in said molten electrolyte bath;

forming metallic aluminum at each cathode;

allowing said metallic aluminum to flow downwardly as molten aluminum along each cathode at which aluminum is formed, toward the bottom of said vessel;

and accumulating said molten aluminum at the bottom of said vessel.

2. A method as recited in claim 1 wherein:

said molten electrolyte is capable of dissolving some alumina;

said vessel has an interior lined with alumina;

and said method comprises maintaining the percentage of alumina, introduced into said slurry as alumina particles, high enough to at least contribute to the avoidance of substantial corrosion of said alumina interior lining by said molten electrolyte.

3. A method as recited in claim 2 wherein:

said step of maintaining the alumina percentage provides said slurry with an alumina content, introduced as alumina, particles, of at least 2 wt. %.

4. A method, as recited in claim 1 and comprising:

maintaining an alumina content in said slurry in the range 2–30 wt. %.

5. A method as recited in claim 4 wherein:

said alumina content in the slurry is maintained in the range 5–10 wt. %.

6. A method as recited in claim 1 wherein:

said bath is maintained at a temperature in the range of about 660° C. to about 800° C.

7. A method as recited in claim 6 wherein:

said bath is maintained at a temperature in the range 730°-760° C.

8. A method as recited in claim 1 wherein:

said alumina particles have a mean size, expressed as equivalent spherical diameter, greater than about 1 micron and less than about 100 microns.

9. A method as recited in claim 8 wherein:

said alumina particles have a mean size in the range of about 2 to about 10 microns.

10. A method as recited in claim 1 wherein:

said anodes are composed of Cu - Ni - Fe cermet.

11. A method as recited in claim 1 wherein:

said molten electrolyte has a composition which provides a relatively low anode resistance, avoids excessive corrosion of the anode and avoids deposition of bath components on said cathodes.

12. A method as recited in claim 1 wherein:

said molten electrolyte contained within said vessel has a composition in the region A on the triangular compositional diagram for $NaF+AlF_3$ eutectic—$KF+AlF_3$ eutectic—LiF, depicted in FIG. 3.

13. A method as recited in claim 1 wherein the ingredients in said molten electrolyte contained within said vessel consist essentially of, in wt. % adjusted to exclude impurities:

| | |
|---|---|
| NaF | 6–26 |
| KF | 7–33 |
| LiF | 1–6 |
| $AlF_3$ | 60–65 |

14. A method as recited in claim 1 comprising:

maintaining an alumina content in said slurry in the range 2–30 wt. %;

and substantially continuously measuring the temperature of said bath with a thermocouple contained within an alumina tube, without substantial corrosion of said alumina tube, by immersing said alumina tube in said slurry and maintaining it there throughout the electrolytic reduction process.

15. A method as recited in claim 1 wherein:

each of said anodes contains copper;

an oxide of copper forms at each anode during the passage of said electric current, at least during the beginning stages in the performance of said method;

and said method comprises the step of incorporating $Li^+$ions into said oxide of copper during said beginning stages, to decrease anode resistance during the performance of said method.

16. A method as recited in claim 15 wherein said incorporating step comprises:

after an initial passage of said electric current, turning the electric current off and then on, a plurality of times during said beginning stages, to allow $Li^+$ions to become incorporated into said metallic oxide during the off part of an on-off cycle.

17. A method as recited in claim 15 wherein:

said molten electrolyte bath contains about 1–6 wt. % LiF.

18. A method as recited in claim 1 comprising:

providing horizontally disposed gas bubble generating means at substantially the bottom of said vessel, in contact with said bath at a location underlying at least said cathodes and the spaces between adjacent electrodes;

generating gas bubbles at said gas bubble generating means;

and allowing said bubbles to pass upwardly from said gas bubble generating means.

19. A method as recited in claim 10 comprising:

maintaining the percentage of alumina in said slurry low enough to provide the slurry with a density less than that of molten alumina.

20. A method as recited in claim 19 wherein:

said step of maintaining the alumina percentage provides said slurry with an alumina content less than about 30 wt. %.

21. A method as recited in claim 18 wherein said gas bubble generating means comprises:

a horizontally disposed, non-consumable, auxiliary anode comprising means for forming bubbles of gaseous oxygen when an electric current is passed through said bath from said auxiliary anode to said cathodes.

22. A method as recited in claim 18 wherein said gas bubble generating means comprises:

a pair of laterally disposed anode parts each extending in an opposite direction from the bottom of each of said anodes to form a plurality of inverted T-shaped anodes;

each of said anode bottom parts underlying the space between its anode and a respective adjacent cathode;

adjacent anodes having anode bottom parts which cooperate to substantially underly the cathode between said adjacent anodes;

each anode bottom part comprising means for forming bubbles of gaseous oxygen when an electric current is passed through said bath from the corresponding anode to an adjacent cathode.

23. A method as recited in claim 18 wherein said gas bubble generating means comprises:

an anode part extending laterally from the bottom of each of said anodes to form a plurality of L-shaped anodes;

each anode bottom part underlying the space between its anode and an adjacent cathode and also at least substantially underlying said adjacent cathode;

each anode bottom part comprising means for forming bubbles of gaseous oxygen when an electric current is passed through said bath from the corresponding anode to an adjacent cathode.

24. A method as recited in claim 18 wherein said gas bubble generating means comprises:

25. A method for the electrolytic reduction of alumina to aluminum in a vessel having a bottom and sidewalls, said method comprising the steps of:

containing within said vessel a molten electrolyte bath consisting essentially of (1) $NaF+AlF_3$ eutectic, (2) $KF+AlF_3$ eutectic and (3) LiF;

maintaining said bath at a temperature substantially below 950° C.;

providing within said bath a plurality of vertically disposed, spaced apart, non-consumable, copper-containing anodes and a plurality of vertically disposed, spaced apart, dimensionally stable cathodes in close, alternating relation with said anodes;

introducing finely divided alumina particles into said bath;

passing an electric current through said bath from said anodes to said cathodes;

forming metallic aluminum at each cathode;

forming an oxide of copper at each anode during the passage of said electric current, at least during the beginning stages in the performance of said method;

and incorporating $Li^+$ions into said oxide of copper during said beginning stages, to decrease anode resistance during the performance of said method.

26. A method as recited in claim 25 wherein said incorporating step comprises:

after an initial passage of said electric current, turning the electric current off and then on, a plurality of times during said beginning stages, to allow $Li^+$ions to become incorporated into said metallic oxide-during the off part of an on-off cycle.

27. A method as recited in claim 26 wherein:

said alumina particles are maintained in suspension in said slurry substantially uniformly throughout said slurry;

and said bubbles of gas rising from said gas bubble generating means at the vessel bottom at least contribute substantially to the maintenance of said suspension.

28. A method as recited in claim 25 wherein:

said molten electrolyte bath contains about 1-6 wt. % LiF.

29. A combination for use in the electrolytic reduction of alumina to aluminum, said combination comprising:

a vessel having a bottom and sidewalls;

a molten electrolyte bath contained within said vessel and consisting essentially of (1) $NaF+AlF_3$ eutectic, (2) $KF+AlF_3$ eutectic and (3) LiF;

said molten electrolyte bath having a density less than that of molten aluminum and less than that of alumina;

means for maintaining said bath at a temperature substantially below 950° C.;

a plurality of electrodes within said bath, said electrodes including a plurality of vertically disposed, spaced apart, non-consumable anodes and a plurality of vertically disposed, spaced apart dimensionally stable cathodes in close, alternating relation to said primary anodes, with a space defined between each pair of adjacent electrodes;

means for introducing finely divided alumina particles into said bath;

means for passing an electric current through said bath from said anodes to said cathodes;

each of said anodes comprising means for forming, from said alumina, during passage of said electric current, bubbles of gaseous oxygen at said anode;

said combination comprising means for allowing said bubbles to pass upwardly from said anodes;

each of said cathodes comprising means for forming metallic aluminum at said cathode, during passage of said electric current;

said combination comprising means for allowing said metallic aluminum, formed at said cathodes, to flow downwardly as molten aluminum along each cathode at which aluminum is formed, toward the bottom of said vessel;

and means at the bottom of said vessel for accumulating and draining molten aluminum.

30. A combination as recited in claim 28 comprising:

a slurry contained within said vessel;

said slurry comprising finely divided alumina particles suspended in said molten electrolyte bath.

31. A combination as recited in claim 29 wherein:

said slurry has an alumina content in the range 30 wt. %.

32. A combination as recited in claim 30 wherein:

said vessel has an interior lined with alumina.

33. A combination as recited in claim 30 and comprising:

an alumina thermocouple tube immersed in said slurry.

34. A combination as recited in claim 29 wherein:

said alumina particles in the slurry have a mean size, expressed as equivalent spherical diameter, greater than about 1 micron and less than about 100 microns.

35. A combination as recited in claim 33 wherein:

said alumina particles have a mean size in the range of about 2 to about 10 microns.

36. A combination as recited in claim 29 wherein:

said slurry has an alumina content in the range 10 wt. %.

37. A combination as recited in claim 28 wherein:

said anodes are composed of Cu - Ni - Fe cermet.

38. A combination as recited in claim 28 wherein:

said molten electrolyte has a composition in the region A on the triangular compositional diagram for $NaF+AlF_3$ eutectic—$KF+AlF_3$ eutectic—LiF, depicted in FIG. 3.

39. A combination as recited in claim 28 wherein the ingredients in said molten electrolyte consist essentially of, in wt. % adjusted to exclude impurities:

40. A combination as recited in claim 28 comprising:

providing horizontally disposed gas bubble generating means at substantially the bottom of said vessel, in contact with said bath at a location underlying at least said cathodes and the spaces between adjacent electrodes;

generating gas bubbles at said gas bubble generating means;

and allowing said bubbles to pass upwardly from said gas bubble generating means.

| | |
|---|---|
| NaF | 6-26 |
| KF | 7-33 |
| LiF | 1-6 |
| $AlF_3$ | 60-65 |

41. A combination as recited in claim 18 wherein said gas bubble generating means comprises:

a horizontally disposed, non-consumable, auxiliary anode comprising means for forming bubbles of gaseous oxygen when an electric current is passed through said bath from said auxiliary anode to said cathodes.

42. A combination as recited in claim 40 wherein said gas bubble generating means comprises:

a pair of laterally disposed anode parts each extending in an opposite direction from the bottom of each of said anodes to form a plurality of inverted T-shaped anodes;

each of said anode bottom parts underlying the space between its anode and a respective adjacent cathode;

adjacent anodes having anode bottom parts which cooperate to substantially underly the cathode between said adjacent anodes;

each anode bottom part comprising means for forming bubbles of gaseous oxygen when an electric current is passed through said bath from the corresponding anode to an adjacent cathode.

43. A combination as recited in claim 40 wherein said gas bubble generating means comprises:

an anode part extending laterally from the bottom of each of said anodes to form a plurality of L-shaped anodes;

each anode bottom part underlying the space between its anode and an adjacent cathode and also at least substantially underlying said adjacent cathode;

each anode bottom part comprising means for forming bubbles of gaseous oxygen when an electric current is passed through said bath from the corresponding anode to an adjacent cathode.

44. A combination as recited in claim 40 wherein said gas bubble generating means comprises gas sparger means.

45. A combination as recited in claim 40 comprising:

a slurry contained within said vessel;

said slurry comprising finely divided alumina particles suspended in said molten electrolyte bath;

said slurry having a density less than that of molten alumina.

46. A combination as recited in claim 45 wherein:

said slurry has an alumina content in the range 2–30 wt. %.

47. A slurry formed during a process for the electrolytic reduction of alumina to aluminum, said slurry consisting essentially of:

finely divided alumina particles suspended in a molten electrolyte;

said molten electrolyte consisting essentially of (1) $NaF+AlF_3$ eutectic, (2) $KF+AlF_3$ eutectic and (3) LiF.

48. A slurry as recited in claim 41 wherein:

said slurry has an alumina content in the range 2–30 wt. %.

49. A slurry as recited in claim 44 wherein:

said alumina particles in the slurry have a mean size, expressed as equivalent spherical diameter, greater than about 1 micron and less than about 100 microns.

50. A slurry as recited in claim 43 wherein:

said slurry has an alumina content in the range 5–10 wt. %.

51. A slurry as recited in claim 43 wherein:

said alumina particles in the slurry have a mean size, expressed as equivalent spherical diameter, greater than about 1 micron and less than about 100 microns.

52. A slurry as recited in claim 47 wherein:

said alumina particles have a mean size in the range of about 2 to about 10 microns.

53. A slurry as recited in claim 43 wherein:

said molten electrolyte has a composition in the region A on the triangular compositional diagram for $NaF+AlF_3$ eutectic—$KF+AlF_3$ eutectic—LiF, depicted in FIG. 3.

54. A slurry as recited in claim 43 wherein the ingredients in said molten electrolyte consist essentially of, in wt. % adjusted to exclude impurities:

| | |
|---|---|
| NaF | 6–26 |
| KF | 7–33 |
| LiF | 1–6 |
| $AlF_3$ | 60–65 |

55. A molten electrolyte for use in the electrolytic reduction of alumina to aluminum, said molten electrolyte consisting essentially of:

(1) $NaF+AlF_3$ eutectic, (2) $KF+AlF_3$ eutectic and (3) LiF.

56. A molten electrolyte as recited in claim 51 wherein:

said molten electrolyte has a composition in region A on the triangular compositional diagram for $NaF+AlF_3$ eutectic—$KF+AlF_3$ eutectic—LiF, depicted in FIG. 3.

57. A molten electrolyte as recited in claim 51 wherein the ingredients in said molten electrolyte consist essentially of, in wt. % adjusted to exclude impurities:

| | |
|---|---|
| NaF | 6–26 |
| KF | 7–33 |
| LiF | 1–6 |
| $AlF_3$ | 60–65 |

58. A composition for use as an electrolyte in the electrolytic reduction of alumina to aluminum, the ingredients in said composition consisting essentially of, in wt. % adjusted to exclude impurities:

| | |
|---|---|
| NaF | 6–26 |
| KF | 7–33 |
| LiF | 1–6 |
| $AlF_3$ | 60–65 |

59. An apparatus for use in the electrolytic reduction of alumina to aluminum, said apparatus comprising:

a vessel having a bottom and sidewalls;

a plurality of electrodes extending into said vessel, said electrodes including a plurality of vertically disposed, spaced apart, non-consumable primary anodes and a plurality of vertically disposed, spaced apart dimensionally stable cathodes in close, alternating relation to said primary anodes, with a space defined between each pair of adjacent electrodes;

said space being defined unfilled by solid material;

and horizontally disposed gas bubble generating means at substantially the bottom of said vessel, at a location underlying at least said cathodes and the spaces between adjacent electrodes.

60. An apparatus as recited in claim 55 wherein:

said vessel has an interior lined with alumina.

61. An apparatus as recited in claim 55 comprising:

an alumina thermocouple tube extending into the interior of said vessel.

62. An apparatus as recited in claim 55 wherein said gas bubble generating means comprising:

a horizontally disposed, non-consumable, auxiliary anode comprising means for forming bubbles of gaseous oxygen, when an electric current is passed through said bath from said auxiliary anode to said cathodes.

63. An apparatus as recited in claim 55 wherein said gas bubble generating means comprises:

a pair of laterally disposed anode parts each extending in an opposite direction from the bottom of each of said anodes to form a plurality of inverted T-shaped anodes;

each of said anode bottom parts underlying the space between its anode and a respective adjacent cathode;

adjacent anodes having anode bottom parts which cooperate to substantially underly the cathode between said adjacent anodes;

each anode bottom part comprising means for forming bubbles of gaseous oxygen when an electric current is passed through said bath from the corresponding anode to an adjacent cathode.

64. An apparatus as recited in claim 55 wherein said gas bubble generating means comprises:

an anode part extending laterally from the bottom of each of said anodes to form a plurality of L-shaped anodes;

each anode bottom part underlying the space between its anode and an adjacent cathode and also at least substantially underlying said adjacent cathode;

each anode bottom part comprising means for forming bubbles of gaseous oxygen when an electric current is passed through said bath from the corresponding anode to an adjacent cathode.

65. An apparatus as recited in claim 55 wherein said gas bubble generating means comprises:

gas sparger means.

* * * * *

UNITED STATES PATENT AND TRADEMARK OFFICE

CERTIFICATE OF CORRECTION

PATENT NO. : 5,006,209

DATED : April 9, 1991

INVENTOR(S) : Theodore R. Beck and Richard J. Brooks

It is certified that error appears in the above-identified patent and that said Letters Patent is hereby corrected as shown below:

Title page, Abstract, line 10, "NaF+Alf$_3$" should be --NaF+AlF$_3$--.

Col. 9, line 13, "CaF2" should be --CaF$_2$--.

Col. 11, line 41, "Lif" should be --LiF--.

Col. 12, line 19, "alumina" should be --aluminum--.

Col. 12, lines 59-60, there should not be a paragraph between "introduced" and "as", and delete the comma after "alumina".

Col. 14, line 7, "recited in claim 10" should be --recited in claim 18--.

Col. 14, line 10, "alumina." should be --aluminum.--.

Col. 14, line 53, after "comprises," there should be a new paragraph which reads --gas sparger means.--.

Col. 15, line 17, "oxide-during" should be --oxide during--.

Col. 15, line 67, "recited in claim 28" should be --recited in claim 29--.

Col. 16, line 3, "recited in claim 29" should be --recited in claim 30--.

Col. 16, line 4, "range 30 wt. %." should be --range 2-30 wt. %.--.

Col. 16, line 6, "recited in claim 30" should be --recited in claim 31--.

Col. 16, line 8, "recited in claim 30" should be --recited in claim 31--.

Col. 16, line 12, "recited in claim 29" should be --recited in claim 30--.

Col. 16, line 17, "recited in claim 33" should be --recited in claim 34--.

Col. 16, line 20, "recited in claim 29" should be --recited in claim 30--.

Col. 16, line 21, "range 10 wt. %" should be --range 5-10% Wt. %--.

Col. 16, line 23, "recited in claim 28" should be --recited in claim 29--.

UNITED STATES PATENT AND TRADEMARK OFFICE

CERTIFICATE OF CORRECTION

PATENT NO. : 5,006,209

DATED : April 9, 1991

INVENTOR(S) : Theodore R. Beck and Richard J. Brooks

It is certified that error appears in the above-identified patent and that said Letters Patent is hereby corrected as shown below:

Col. 16, line 25, "recited in claim 28" should be --recited in claim 29--.

Col. 16, line 30, "recited in claim 28" should be --recited in claim 29--.

Col. 16, line 32, after "impurities:" insert the following paragraph:

| | |
|---|---|
| --NaF | 6-26 |
| KF | 7-33 |
| LiF | 1-6 |
| $AlF_3$ | 60-65.-- |

Col. 16, line 33, "recited in claim 28" should be --recited in claim 29--.

Col. 16, lines 45-49, table should be deleted.

Col. 16, line 50, "recited in claim 18" should be --recited in claim 40--.

Col. 17, line 38, "recited in claim 41" should be --recited in claim 47--.

Col. 17, line 41, "recited in claim 44" should be --recited in claim 48--.

Col. 17, line 46, "recited in claim 43" should be --recited in claim 47--.

Col. 17, line 49, "recited in claim 43" should be --recited in claim 47--.

Col. 17, line 55, "recited in claim 47" should be --recited in claim 51--.

Col. 17, line 58, "recited in claim 43" should be --recited in claim 47--.

Col. 17, line 63, "recited in claim 43" should be --recited in claim 47--.

Col. 18, line 11, "recited in claim 51" should be --recited in claim 55--.

Col. 18, line 17, "recited in claim 51" should be --recited in claim 55--.

Col. 18, line 50, "being defined unfilled" should be --being unfilled--.

Col. 18, line 55, "recited in claim 55" should be --recited in claim 59--.

UNITED STATES PATENT AND TRADEMARK OFFICE

CERTIFICATE OF CORRECTION

PATENT NO. : 5,006,209

DATED : April 9, 1991

INVENTOR(S) : Theodore R. Beck and Richard J. Brooks

It is certified that error appears in the above-identified patent and that said Letters Patent is hereby corrected as shown below:

Col. 18, line 57, "recited in claim 55" should be --recited in claim 59--.

Col. 18, line 60, "recited in claim 55" should be --recited in claim 59--.

Col. 18, line 64, "oxygen, when" should be --oxygen when--.

Col. 18, line 67, "recited in claim 55" should be --recited in claim 59--.

Col. 20, line 1, "recited in claim 55" should be --recited in claim 59--.

Col. 20, line 14, "recited in claim 55" should be --recited in claim 59--.

Signed and Sealed this

Sixth Day of October, 1992

*Attest:*

DOUGLAS B. COMER

*Attesting Officer*

*Acting Commissioner of Patents and Trademarks*